United States Patent [19]

Hubbard et al.

[11] 4,094,708

[45] June 13, 1978

[54] TITANIUM-BASE ALLOYS

[75] Inventors: Roger Thomas John Hubbard, Sutton Coldfield; Richard Ernest Goosey, Solihull; Donald Francis Neal, Lichfield, all of England

[73] Assignee: Imperial Metal Industries (KYNOCH) Limited, Birmingham, England

[21] Appl. No.: 769,786

[22] Filed: Feb. 17, 1977

Related U.S. Application Data

[63] Continuation of Ser. No. 305,329, Nov. 10, 1972, abandoned, which is a continuation-in-part of Ser. No. 797,674, Feb. 7, 1969, abandoned.

[30] Foreign Application Priority Data

Feb. 16, 1968 United Kingdom ..... 7776/68

[51] Int. Cl.[2] ..... C22C 14/00

[52] U.S. Cl. ..... 148/32.5; 75/175.5; 148/32; 148/133; 148/158

[58] Field of Search ..... 75/175.5; 148/32, 32.5, 148/133, 158

[56] References Cited

U.S. PATENT DOCUMENTS

| | | | |
|---|---|---|---|
| 3,049,425 | 8/1962 | Fentiman et al. | 75/175.5 |
| 3,105,759 | 10/1963 | Fentiman et al. | 75/175.5 |
| 3,378,368 | 4/1968 | Minton et al. | 75/175.5 |

FOREIGN PATENT DOCUMENTS

| | | | |
|---|---|---|---|
| 1,477,221 | 3/1967 | France | 75/175.5 |
| 1,079,416 | 8/1967 | United Kingdom | 75/175.5 |

*Primary Examiner*—Arthur J. Steiner
*Attorney, Agent, or Firm*—Cushman, Darby & Cushman

[57] ABSTRACT

A high strength creep resistant titanium alloy comprising titanium, 6% aluminium, 5% zirconium, 0.5% molybdenum, 0.25% silicon is disclosed in a particular heat-treated condition. The alloy is particularly useful for engine components.

2 Claims, 8 Drawing Figures

TITANIUM-BASE ALLOYS

REFERENCE TO RELATED APPLICATION

This is a continuation of application Ser. No. 305,329 filed Nov. 10, 1972 as a continuation-in-part of application Ser. No. 797,674 filed Feb. 7, 1969, both of which are now abandoned.

FIELD OF INVENTION

This invention relates to titanium-base alloys possessing good creep and tensile strength and resistance to embrittlement on exposure to high temperature.

BACKGROUND TO THE INVENTION

Alloys containing nominally 6% aluminium, 5% zirconium, about 0.2% silicon, with or without carbon, and up to about 2% of tungsten have been proposed for use in aircraft engines where service temperatures of up to 520° C are encountered. Dimensional stability in such conditions is of the greatest importance and tolerances are extremely small. The alloys above-mentioned possess excellent high temperature strength but experience has shown that they are not always sufficiently resistant to embrittlement on exposure to high temperatures. Embrittlement in this context means loss of ductility measured at room temperature before and after exposure to high temperatures.

In the fields of application for which these alloys are intended, the relatively high strength must be combined with room temperature ductility of at least 15% reduction in area and 10% elongation measured on a gauge length of $4\sqrt{S_o}$, where $S_o$ = cross-sectional area. Furthermore, these values must be retained after exposure to service temperatures since in practice alloys used in aircraft engine components are subjected to thermal cycles between normal atmospheric temperature and service temperatures of at least 500° C. At the same time, creep resistance of a very high order is required and, since shaping is involved, forgeability must be good to avoid any possibility of cracking. Welding is frequently used in fabrication of parts made from such alloys and there must be no embrittlement as a result of local heating to welding temperatures and a high degree of weldability is required. Titanium alloys for the advanced aircraft engines now required have to meet a criterion in creep properties of 0.1% strain in 100 hours exposure to a stress of 20 tonf/in$^2$ at a temperature of 520° C.

Titanium alloys which are intended for use at elevated temperatures have to have a range of properties very different from those alloys which are only for use at room temperature. Such room temperature alloys are exemplified by, for example, the constructional alloy disclosed in British Patent Specification No. 1,079,416. This discloses a range of compositions, but the preferred composition is a 6% aluminium, 5% zirconium, 4% molybdenum, 0.2% silicon, 0.1% carbon. This alloy is given a heat-treatment which comprises heating the alloy to 900° C, water quenching and aging for 24 hours at 500° C. The result of the heat-treatment is that the alloy is utilised in the alpha plus beta condition, and the alloy obtains its strength from the hardening of the beta phase by the molybdenum. As can be seen from Table I in the British Patent, the ductility of the 4% molybdenum alloy is reasonable provided the percentage of carbon present is kept to a reasonable level. Thus in the alpha plus beta condition in which the alloy of the British Patent works, there is no need to reduce the molybdenum content to obtain good ductility. Such constructional alloys are concerned with properties such as forgeability and high tensile strength rather than with high temperature strength, and Table II of the British Patent is an example of the emphasis placed on forgeability in such an alloy.

The particular family of properties required by a titanium alloy for use in high temperature high stress conditions include weldability, high creep strength, good post-creep ductility, and good tensile and proof stress properties amongst many others. However, two extremely important properties, high creep strength and good post-creep ductility are not required by constructional alloys.

Titanium alloys used for high temperature applications may suffer from many defects, and in addition to the requirements for weldability, high creep strength, good post-creep ductility and good tensile and proof stress properties, a resistance to ordering is required. As aluminium and tin have an analagous effect on ordering, and 3% tin is equivalent to 1% aluminium, this equivalence has become an accepted factor in considering titanium alloys generally. In the past tin and aluminium have been considered mutually replaceable at will. Thus in French Patent No. 1,477,221 which is concerned with a creep resistant high temperature alloy, the specification refers to the use of both tin and aluminium, and it may have been thought that these two elements could be interchanged at will. It has now been discovered that this is not always so.

The present invention is concerned with an alloy having good stability to prolonged exposure to elevated temperatures under stress.

OBJECTS OF THE INVENTION

It is an object of the present invention to provide a high temperature creep resistant titanium alloy which is weldable and suitable for use for the manufacture of engine components.

It is a further object of the present invention to provide a high temperature creep resistant titanium alloy which can be used having a creep strain of less than 0.1% at a stress of 20 tonf/in$^2$ for 100 hours at 520° C.

It is a still further object of the present invention to provide a heat-treated titanium alloy having a titanium molybdenum silicide precipitate at the alpha-beta boundaries which titanium molybdenum silicide has a principally body centred cubic (BCC) phase.

It is a yet further object of the invention to provide a titanium alloy in which the strength of the alloy can be increased at the expense of a reduction in ductility.

Other and still further objects of the present invention will be set out below and will be apparent from the claims appended hereto.

DEFINITION OF THE INVENTION

By the present invention there is provided a high strength creep resistant titanium-base alloy consisting of 6% aluminium, 5% zirconium, 0.5% molybdenum, 0.25% silicon, balance titanium, apart from impurities, said alloy having a creep strain less than 0.1% in 100 hours at 520° C at a stress of 20 tonf/in$^2$, the alloy being beta solution treated at 1050° C, cooled and aged for not less than 24 hours at a temperature not less than 500° C, and air cooled, whereby the alloy has an alpha plate-like structure with precipitate at the alpha plate boundaries, said precipitate being a titanium molybdenum silicide, and having a principally body centred cubic structure.

The present invention further provides an engine component for use in conditions of elevated temperature and under load, said component being formed from an alloy which consists of a 6% aluminium, 5% zirconium, 0.5% molybdenum, 0.25% silicon, balance titanium apart from impurities, said alloy having a creep strain less than 0.1% in 100 hours at 520° C at a stress of 20 tonf/in$^2$, the alloy being beta solution treated at 1050° C, cooled and aged for not less than 24 hours at a temperature not less than 500° C, and air cooled, whereby the alloy has an alpha plate-like structure with precipitate at the alpha plate boundaries, said precipitate being a titanium molybdenum silicide, and having a principally body centred cubic structure.

DESCRIPTION OF THE INVENTION

Figure 1:
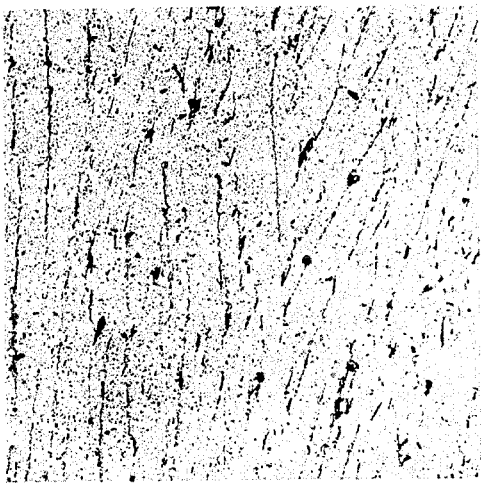
FIG. 1 is a carbon extraction replica of an alpha platelet structure in a Ti-3.2% Al-6% Sn-5% Zr-0.5% Mo-0.5% Si alloy × 2500.

The invention is concerned with a titanium alloy intended for use at high operating temperatures under conditions of stress. The alloy is often, in use, made into engine components and the like which are thermally cycled from ambient temperature to an operating temperature and back to ambient temperature on a regular basis.

The present invention is partly based on the discovery that difficulties encountered with prior alloys as referred to above can be obviated, and that high creep strength and forgeability and weldability may be combined with freedom from embrittlement on exposure to high temperatures when molybdenum is present in a specified amount together with other components in the amount specified. If the specified amount of molybdenum is exceeded there is a marked and serious loss of ductility after exposure to high temperatures which reduce this property below the level acceptable for use in aircraft high temperature applications. The increase in molybdenum above the critical limit also results in embrittlement at any weld points, particularly in the post-creep condition. It has been discovered that a compound of molybdenum tends to precipitate out during creep which gives rise to the lower post-creep ductility. Below the specified level of molybdenum content, there is insufficient beta stabilising element present to be effective, and the required strength level is not realised.

The alloy composition of the invention contains 6% aluminium, 5% zirconium, 0.5% molybdenum and 0.25% silicon, rest titanium. This alloy has a room temperature tensile strength in excess of 60 tonf/in$^2$, a ductility exceeding 10% elongation measured on a gauge length of $4\sqrt{S_o}$, a 15% reduction in area and has a density slightly less than that of pure titanium.

In order to obtain adequate strength at room temperature, the presence of a beta stabilising element is necessary. Molybdenum is particularly effective in this respect, but it has been discovered that it is harmful to ductility on exposure to high temperatures. This disadvantage is overcome by restricting the molybdenum to 0.5%. Below the limit, the strengthening effect is insufficient to produce the strength levels required in this type of alloy, and exceeding the upper limit causes the ductility to fall below that which can be used in aircraft engines.

Table I indicates the effect of molybdenum content on the stability of an alloy containing titanium, 6% aluminium, 5% zirconium and 0.25% silicon after exposure at 520° C. Tests were carried out on $\frac{3}{8}$ in sq rod heat-treated for $\frac{1}{2}$ hour at 1050° C and oil quenched, followed by 24 hours at 500° C and air cooled. Test pieces machined from this rod were exposed for 300 hours at 520° C and then tensile tested at room temperature. As can be seen from Table I, an alloy containing 0.5% (actually 0.46%) molybdenum showed no loss of ductility after exposure whereas an alloy containing 0.97% was severely embrittled and after exposure possessed ductility below the level acceptable for aero engine applications. The values obtained on the alloy containing 0.77% molybdenum after exposure to the test temperature indicate that the ductility is on the borderline between acceptability and non-acceptability. Thus an alloy with a molybdenum content of 0.5%. is clearly superior to other alloy compositions illustrated in Table I.

Table II shows the effect of exposing alloys containing 5.8–6.5% aluminium for 300 hours at 520° C under a creep stress of 20 tonf/in$^2$ and for 1000 hours at 450° C under a stress of 25 tonf/in$^2$. Alloys containing 5.8–6% aluminium show no significant loss of ductility after such exposures but an alloy containing 6.5% aluminium loses ductility and is, therefore, not acceptable.

Zirconium is an alpha stabiliser which is an efficient strengthener, and the content of 5% produces optimum effects with 6% aluminium.

It is well known that silicon improves the creep resistance of near alpha type alloys like those of the invention. We have found that the silicon content, must, however, not exceed a particular level if the good stability is to be maintained. Table III shows that increasing the silicon content from 0.25% (actually 0.27%) to 0.39/0.4% produces some loss of ductility after creep exposure for 100 hours at 520° C under 20 tonf/in$^2$, and thus extra amounts of silicon seriously affect the properties of the alloy.

Optimum combination of strength, ductility and creep resistance is obtained in alloys of the invention by heat-treating the alloy in the beta field at 1050° C followed by oil quenching or air cooling and aging. As a result, it is possible to hot work the alloy in the beta field and this can be carried out at temperatures of 1050°–1100° C. At this temperature the alloy is relatively soft and can be forged without difficulty.

The alloy of the invention is fusion weldable without significant loss of ductility in the welded area. This is important in that components can be fabricated by welding techniques thereby facilitating manufacturing processes. Table IV shows the results of tensile testing test pieces made from an alloy having the composition 6% aluminium, 5% zirconium, 0.5% molybdenum, 0.25% silicon of the invention. The test pieces were machined from 0.07 inch thick sheet and the second and third in the Table were welded along their longitudinal axes by two welding processes. The gauge length of 2 inches is normally used for sheet and gives lower ductility values than when a gauge length equal to $4\sqrt{S_o}$ is used. In the present instance, an elongation of 7% on a 2 inch gauge length is equivalent to an elongation of about 10% on a gauge length of $4\sqrt{S_o}$ as is used in Tables I, II and III. It will be seen from Table IV that the alloys do not suffer embrittlement as a result of welding.

The alloy was also tested for embrittlement in the form of plate 0.15 inch thick and the results of these tests are shown in Table V. There is an increase in tensile strength and some loss of ductility as a result of the heating effect of the welding operation but there is no significant loss of ductility after exposure for 300 hours at 520° C. The remarks relative to gauge length made in reference to Table IV are applicable to Table V.

The alloy in accordance with the invention is responsive even in large sections to heat-treatment to produce good creep properties with good ductility. Table VI shows the tensile properties before and after exposure to high temperature and creep properties at 520° C of two heat-treated, thick discs which simulate aircraft engine components. For the purpose of testing the discs were cut up after heat-treatment and test pieces were machined from samples taken from three positions: in the central plane parallel to the faces of the disc, and in parallel planes near the top and bottom faces. The samples were radial and at mid-radius position.

It will be observed that the criterion of creep resistance of not more than 0.1% total plastic strain in 100 hours at 520° C under a stress of 20 tonf/in$^2$ is complied with even at a thickness of 2½ inches. These test conditions are severe for titanium alloys. The minimum acceptable tensile strength of 60 tonf/in$^2$ is exceeded and the ductility as shown by elongation and reduction in area well exceed the minima. The important feature of the ductility values shown in Table VI is the maintenance of the good ductility values after exposure to a temperature of 520° C. When tested in this way, known alloys of this type having other amounts of beta stabilising elements fail to show sufficient ductility to be safely used in aircraft engines.

One of the attractions of titanium is its relatively low density but this advantage can be lost to some extent by alloying with high density elements. In aircraft applications density is of the greatest importance and high strength to weight ratios are essential in these applications in addition to the high level of creep and ductility values.

An advantage of the present invention is that excellent creep properties at high temperatures, stable ductility on thermal cycling, good forgeability and weldability are accompanied by a density slightly less than that of pure titanium.

Figure 2:
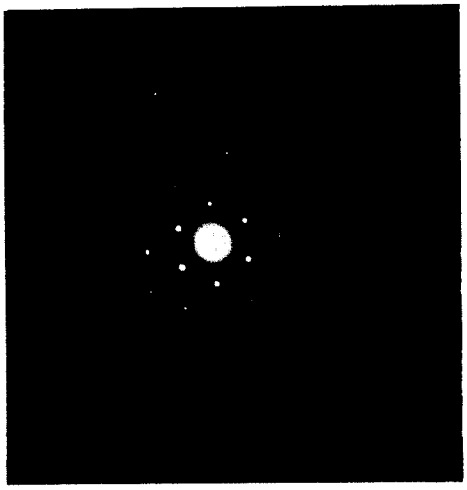
FIG. 2 is an electron diffraction pattern from the precipitate of FIG. 1.
Figure 3:
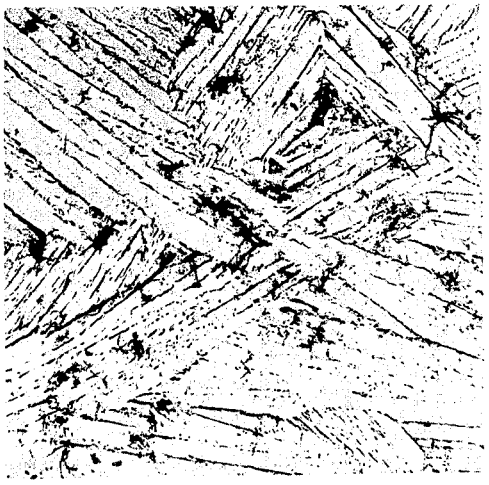
FIG. 3 is a carbon extraction replica of an alpha platelet structure in a Ti-5.2% Al-5% Zr-0.5% Mo-0.5% Si alloy × 2500.
Figure 4:
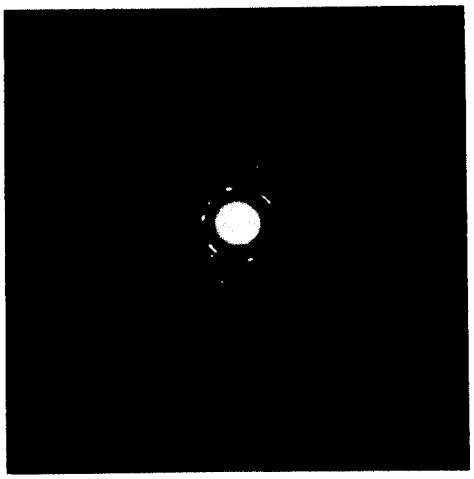
FIG. 4 is an electron diffraction pattern from the precipitate of FIG. 3.

It has been discovered that the 3:1 relationship for aluminium and tin cannot be used for the present alloy when comparing it with known prior art alloys, since the presence of tin has been found to have an effect on the formation of an important precipitate at the alpha plate boundaries when the alloy is in the heat-treated condition. The basic descovery which has been made in connection with the alloy of the present invention is that a silicide precipitate which forms at the alpha plate boundary is affected by the presence of tin in the alloy. Thus a Ti-3.2% Al-6% Sn-5% Zr-0.5% Mo-0.5% Si has a silicide precipitate at the alpha plate boundaries which is principally body centred cubic (BCC) in structure (FIGS. 1 and 2). If, however, the 6% of tin is replaced on a 3:1 basis by 2% aluminium to give a Ti-5.2% Al-5% Zr-0.5% Mo-0.5% Si alloy, the silicide precipitate has a principally face centred cubic (FCC) structure (FIGS. 3 and 4).

Figure 5:
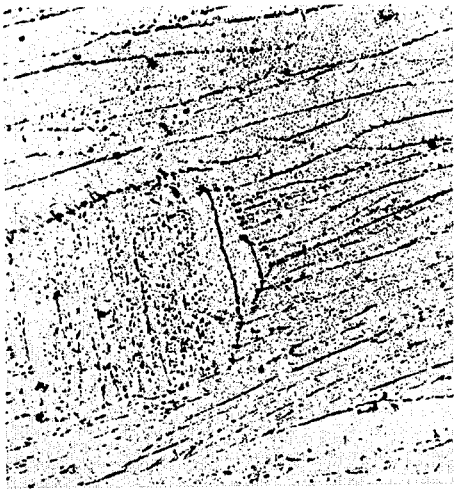
FIG. 5 is a carbon extraction replica of an alpha platelet structure in a Ti-6% Al-5% Sr-0.5% Mo-0.25% Si alloy × 2500.
Figure 6:
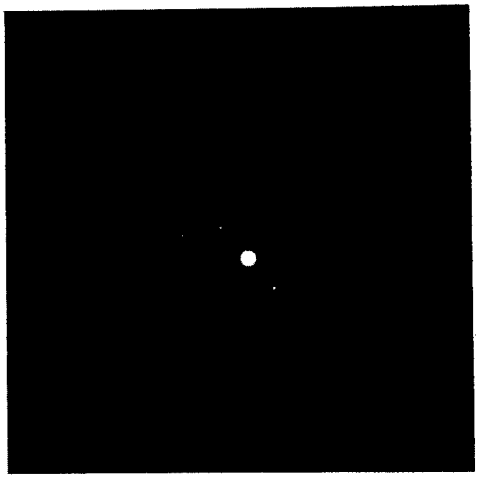
FIG. 6 is an electron diffraction pattern from the precipitate of FIG. 5.

It appears, therefore, that the tin has an effect on the silicide precipitate and, therefore, on the eventual properties of the alloy. The precipitate formed at the alpha plate boundary of the alloy composition of the present invention Ti-6% Al-5% Zr-0.5% Mo-0.25% Si is again mainly BCC (FIGS. 5 and 6). It appears that in the tin-free alloys, as the silicon content is increased, the precipitate changes form from mainly BCC to mainly FCC, whereas the presence of tin suppresses this change. Since FCC is detrimental to ductility, the BCC is clearly better. This is evidence of the differing nature of the alloys containing and not containing tin.

Figure 7:
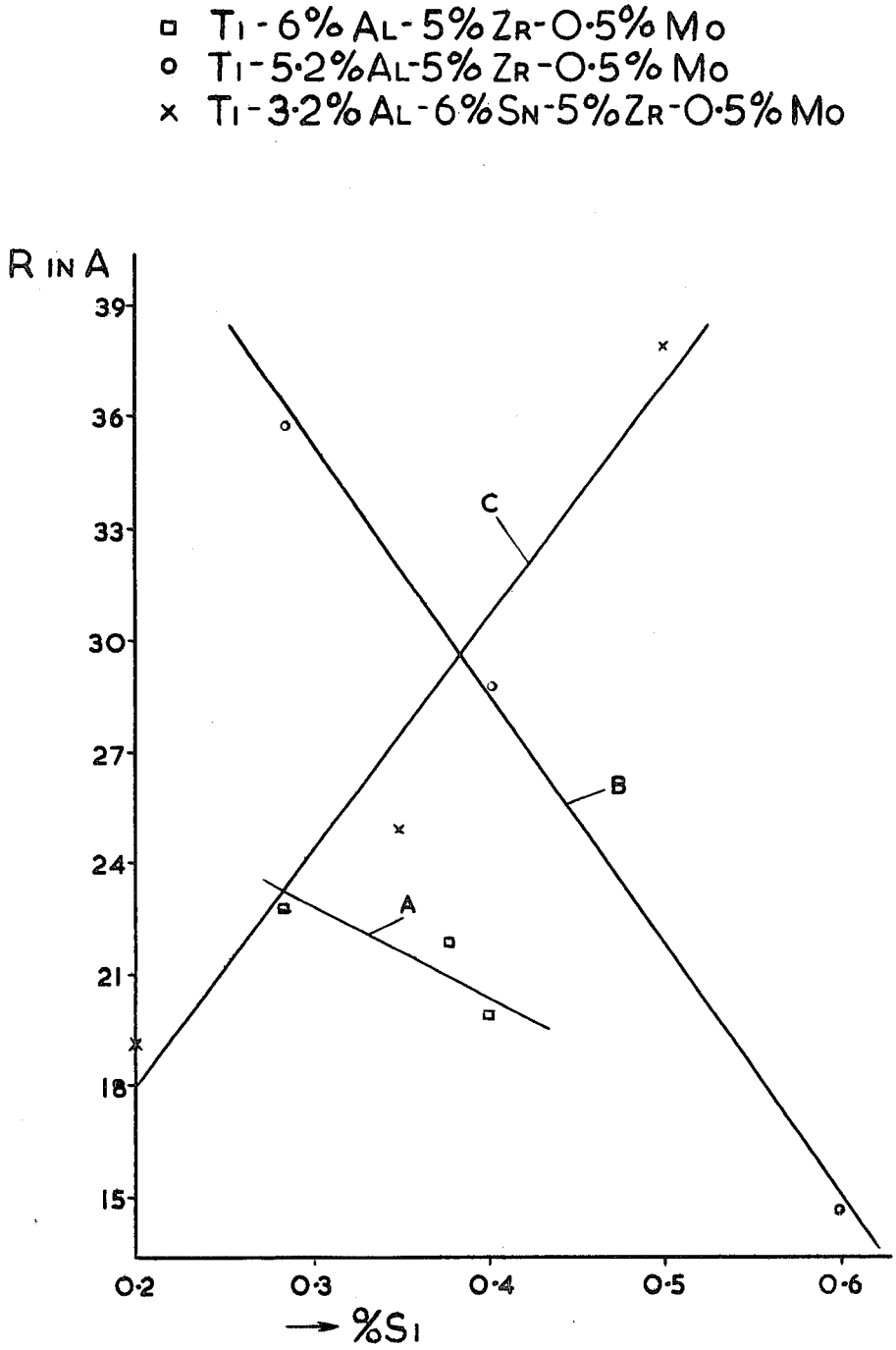
FIG. 7 is a graph of percentage silicon vs ductility for various alloys.

A further example of the difference is the effect of silicon content on the tensile ductility of the tin-containing and non-tin-containing alloys. FIG. 7 shows reduction in area vs silicon content for A a Ti-6% Al-5% Zr-0.5% Mo base alloy B a Ti-5.2% Al-5% Zr-0.5% Mo base alloy, and C a Ti-3.2% Al-6% Sn-5% Zr-0.5% Mo base alloy.

It can be clearly seen that the tin-containing alloy behaves in a radically different manner to the tin-free alloys. The lines A and B result from our own work, but the line C is derived from samples Nos. 12, 13 and 10 in Table II of French Pat. No. 1,477,221.

The difference in the effect of the tin-containing and the tin-free alloys show quite clearly in the effect of silicon on their ductility, and it is quite clear that at the level of sophistication of the alloy of the present invention, the tin-free and tin-containing alloys are not analagous. The implication to be gained from the tin-containing alloys is that silicon is beneficial to ductility. However, it can be seen quite clearly from FIG. 7 that in the alloy of the present invention, increasing silicon has a detrimental effect on ductility. It is interesting to note that at the higher level of aluminium, the rate at which ductility falls off is much greater than that at the lower level of aluminium. The reason for this is not known.

Thus a person interested to produce a ductile alloy would, reading the French specification, consider that a high silicon level was beneficial to ductility, whereas in practice this is not so in the tin-free alloy.

When comparing a Ti-5% Al-5% Zr-0.5% Mo-0.25% Si alloy with a Ti-6% Al-5% Zr-0.5% Mo-0.25% Si alloy, affidavits filed in connection with our application Ser. No. 797,674 show that a 20% increase in the level of aluminium from 5% to 6% gives rise to a 90% improvement in creep strength.

Table I as mentioned above shows the effect of change in the molybdenum content on the ductility before and after exposure at elevated temperatures.

Figure 8:
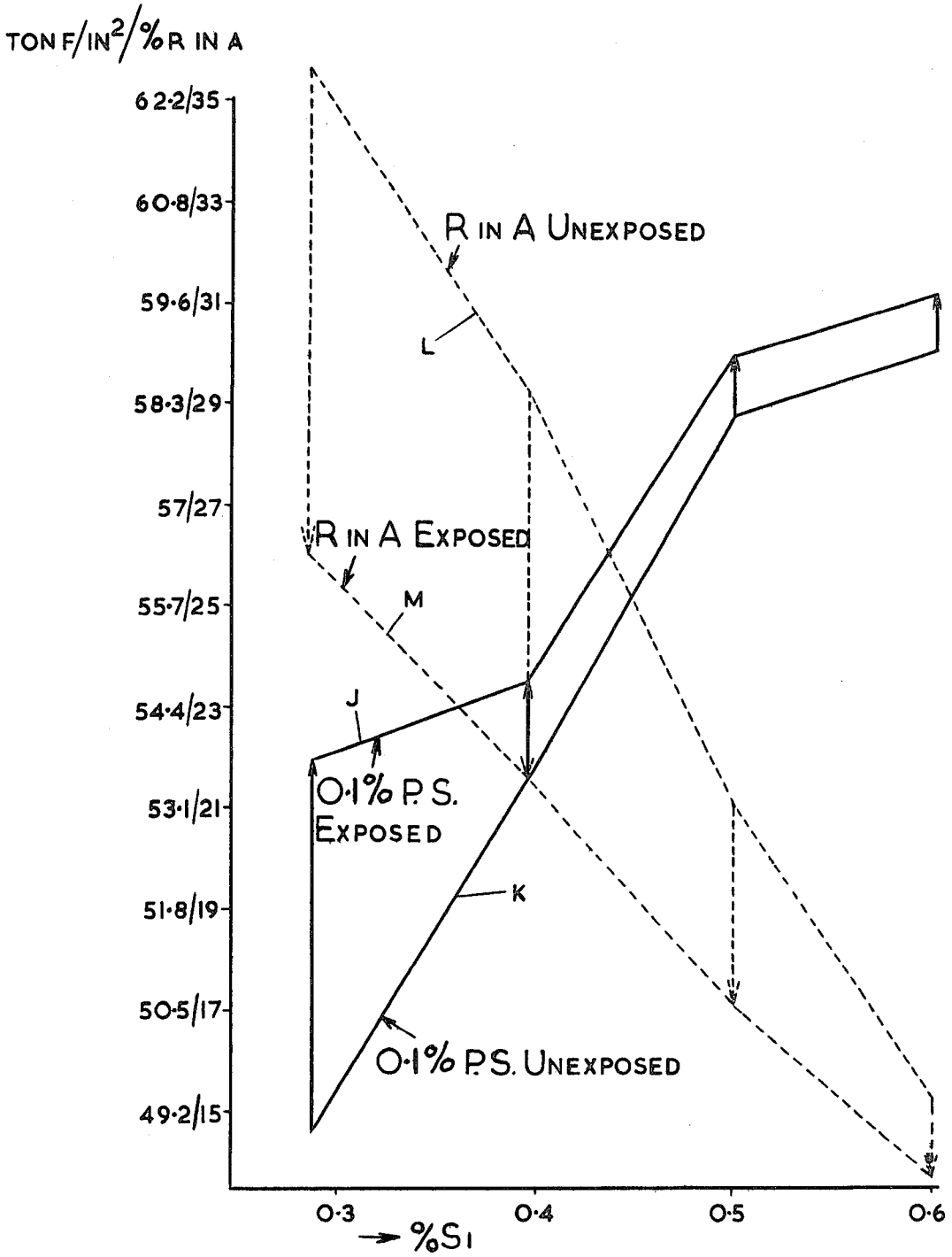
FIG. 8 is a graph of the effect of silicon content on tensile properties.

Referring to FIG. 8, which illustrates graphically the effect of silicon content on the strength and ductility properties of a Ti-5.2% Al-5% Zr-0.5% molybdenum alloy, lines J and K illustrate the effect of silicon on the 0.1% proof stress after and before, respectively, exposure at 520° C for 100 hours. It can be seen that the 0.1% proof stress increases on exposure. The ductility suffers correspondingly and lines L and M illustrate the effect on ductility before and after exposure at 520° C for 100 hours. It can be seen that 0.29% silicon in this alloy gives a large increase in proof strength of the alloy after exposure at 520° C for 100 hours.

TABLE I

Effect of Molybdenum on the Room Temperature Ductility after Exposure at Elevated Temperature

| Mo content % | Exposure given to test piece after machining (non-stressed) | Tensile properties before or after exposures: 0.1% Proof Stress tonf/in² | Tensile Strength tonf/in² | Elongation 4 $\sqrt{S_o}$ % | Reduction in area % |
|---|---|---|---|---|---|
| 0.46 | None | 64.2 | 75.7 | 13 | 16.5 |
| | 300h 520° C | 65.8 | 76.5 | 13 | 16 |
| 0.77 | None | | test piece defective | | |
| | 300h 520° C | 67.0 | 77.4 | 9 | 7 |
| 0.97 | None | 71.8 | 81.6 | 9 | 11.5 |
| | 300h 520° C | 72.8 | 79.0 | 3 | 4 |

TABLE II

The Effect of Aluminium Content on the Room Temperature Ductility After Exposure at Elevated Temperatures

| Nominal Aluminium Content % | Creep Exposure Conditions: Temperature ° C | Time h | Stress tonf/in² | Total Plastic Strain % | Tensile properties before and after exposure: 0.1% proof stress tonf/in² | 0.2% proof stress tonf/in² | Tensile strength tonf/in² | % Elongation on 4 $\sqrt{S_o}$ | Reduction in area % |
|---|---|---|---|---|---|---|---|---|---|
| 6.5 | — | — | — | — | 59.7 | 61.2 | 69.1 | 14 | 21 |
| | 520 | 300 | 20 | 0.097 | 62.9 | 64.5 | 70.0 | 5 | 8 |
| 6.0 | — | — | — | — | 56.9 | 58.1 | 66.6 | 10 | 19 |
| | 520 | 300 | 20 | 0.068 | 57.6 | 58.1 | 65.0 | 13 | 16 |
| 6.5 | — | — | — | — | 61.0 | 63.1 | 70.1 | 14 | 22 |
| | 1000 | 450 | 25 | not measured | 61.7 | 63.1 | 69.8 | 6 | 9 |
| 6.0 | — | — | — | — | 57.3 | 58.9 | 67.9 | 11 | 21 |
| | 1000 | 450 | 25 | 0.025 | 59.4 | 60.1 | 67.1 | 13 | 18 |
| 5.8 | — | — | — | — | 54.2 | 55.8 | 64.9 | 14 | 25 |
| | 1000 | 450 | 25 | 0.049 | 59.1 | 60.2 | 66.4 | 14 | 22 |

All material heat treated for 1 hour at 1050° C and oil quenched followed by 24 hours at 550° C and air cooled.

TABLE III

Effect of Silicon Content on the Room Temperature Ductility After Exposure at Elevated Temperature

| Silicon Content % | % total plastic strain in 100 h at 520° C under stress of 20 tonf/in² | Tensile properties before and after creep exposure: 0.1% proof stress tonf/in² | 0.2% proof stress tonf/in² | Tensile strength tonf/in² | Elongation 4 $\sqrt{S_o}$ % | Reduction in area % |
|---|---|---|---|---|---|---|
| 0.27 | control | 60.5 | 61.1 | 69.0 | 15 | 23 |
| | 0.031 | 63.4 | 64.3 | 70.0 | 15 | 20 |
| 0.39 | control | 59.6 | 61.1 | 69.0 | 13 | 22 |
| | 0.029 | 62.6 | 63.4 | 69.1 | 10 | 14 |
| 0.40 | control | 57.3 | 59.5 | 66.4 | 12 | 20 |
| | 0.027 | 59.8 | 61.1 | 67.5 | 10 | 13 |

All materials heat treated for 1 hour at 1050° C and oil-quenched, followed by 24 hours at 550° C and air cooled.

TABLE IV

| | 0.1% proof stress tonf/in² | Tensile strength tonf/in² | Elongation on 2in. % |
|---|---|---|---|
| No weld | 62.6 | 71.8 | 6 |
| Electron beam weld | 60.9 | 70.9 | 8 |
| Argon-arc weld | 60.6 | 72.5 | 7 |

0.07in. sheet heat treated for 15 minutes at 1050° C, air cooled, heat treated for 24 hours at 500° C and air coled.

TABLE V

| | 0.1% proof stress tonf/in² | Tensile strength tonf/in² | Elongation on 2in. % |
|---|---|---|---|
| Control, unwelded | 56.1 | 63.1 | 10 |
| 300 hours at 520° C | 57.9 | 63.1 | 8 |

TABLE V-continued

| | 0.1% proof stress tonf/in$^2$ | Tensile strength tonf/in$^2$ | Elongation on 2in. % |
|---|---|---|---|
| Control | 54.1 | 67.3 | 6 |
| Longitudinal weld 300 hours at 520° C | 63.1 | 71.2 | 5.5 |

0.15in. plate heat treated for 15 minutes at 1050° C, air cooled, heat treated for 24 hours at 500° C and air cooled.

0.15in. plate heat treated for 15 minutes at 1050° C, air cooled, heat treated for 24 hours at 500° C and air cooled.

TABLE VI

| Disc size and heat-treatment | Test piece location in disc (all radial and at mid-radius position) | % Total plastic strain in 100 h at 520° C under stress of 20 tonf/in$^2$ | Tensile Properties Before and After Exposure to 520° C: 0.1% proof stress tonf/in$^2$ | 0.2% proof stress tonf/in$^2$ | Tensile strength tonf/in$^2$ | Elongation 4 $\sqrt{S_o}$ % | Reduction in area |
|---|---|---|---|---|---|---|---|
| 2in. din × 1¾ in. thick Weight 28 lbs. 1¾h at 1050° C Oil quenched + + air cooled | Edge of thickness-top face | — | 55.4 | 57.5 | 64.8 | 14.5 | 56 |
| | | 0.050 | 57.0 | 58.6 | 63.5 | 13 | 20 |
| | Center of thickness | — | 53.1 | 55.1 | 63.4 | 11 | 25 |
| | Edge of thickness-bottom face | — | 57.6 | 58.6 | 65.6 | 15 | 25 |
| | | 0.049 | 57.1 | 58.4 | 65.2 | 14.5 | 23 |
| 12in. din × 2½in. thick Weight 46 lbs. 2½h at 1050° C Oil quenched + 24 h at 500° C + air cooled | Edge of thickness-top face | — | 56.1 | 57.1 | 65.1 | 13.5 | 21 |
| | | 0.075 | 57.0 | 57.8 | 63.5 | 14 | 18 |
| | Center of thickness | — | 53.6 | 54.8 | 62.1 | 13.5 | 24 |
| | | 0.066 | 55.0 | 55.8 | 60.8 | 12.5 | 17 |
| | Edge of thickness-bottom face | — | 56.5 | 58.1 | 65.6 | 13.5 | 25 |
| | | 0.100 | 57.9 | — | 64.7 | 13.5 | 21 |

We claim:

1. A high strength creep resistant titanium-base alloy consisting of 6% aluminium, 5% zirconium, 0.5% molybdenum, 0.25% silicon, balance titanium, apart from impurities, said alloy having a creep strain less than 0.1% in 100 hours at 520° C at a stress of 20 tonf/in$^2$ and in the as welded condition a room temperature ductility of at least 15% reduction in area and 10% elongation when measured on a gauge length of $4\sqrt{S_o}$ where $S_o$ is the cross-sectional area, the alloy being beta solution treated at 1050° C, cooled and aged for not less than 24 hours at a temperature not less than 500° C, and air cooled, whereby the alloy has an alpha plate-like structure with precipitate at the alpha plate boundaries, said precipitate being a titanium/molybdenum silicide, and having a principally body centred cubic structure.

2. A shaped aircraft engine component which in service is subjected to a temperature of up to 520° C, said component being formed from an alloy which consists of a 6% aluminium, 5% zirconium, 0.5% molybdenum, 0.25% silicon, balance titanium, apart from impurities, said alloy having a creep strain less than 0.1% in 100 hours at 520° C at a stress of 20 tonf/in$^2$ and in the as welded condition a room temperature ductility of at least 15% reduction in area and 10% elongation when measured on a gauge length of $4\sqrt{S_o}$ where $S_o$ is the cross-sectional area, the alloy being beta solution treated at 1050° C, cooled and aged for not less than 24 hours at a temperature not less than 500° C, and air cooled, whereby the alloy has an alpha plate-like structure with precipitate at the alpha plate boundaries, said precipitate being a titanium/molybdenum silicide and having a principally body centred cubic structure.

* * * * *